US007584514B1

(12) United States Patent
Salas

(10) Patent No.: US 7,584,514 B1
(45) Date of Patent: Sep. 8, 2009

(54) FOLDABLE INFANT SLEEPING APPARATUS

(76) Inventor: Whinston Salas, 837 SE. 8 Ct., Apartment 2, Miami, FL (US) 33010

( * ) Notice: Subject to any disclaimer, the term of this patent is extended or adjusted under 35 U.S.C. 154(b) by 0 days.

(21) Appl. No.: 12/270,151

(22) Filed: Nov. 13, 2008

(51) Int. Cl.
*A47D 7/04* (2006.01)

(52) U.S. Cl. ..... 5/95; 5/659; 5/93.2

(58) Field of Classification Search ..... 5/93.2, 5/94, 95, 426, 659, 507.1
See application file for complete search history.

(56) References Cited

U.S. PATENT DOCUMENTS 874,481 A 12/1907 Nall
918,789 A * 4/1909 Spear ..... 5/95
2,667,647 A * 2/1954 Reggiani ..... 5/95
D174,004 S 2/1955 Schiffman
5,148,561 A 9/1992 Tharalson et al.
5,172,435 A 12/1992 Griffin et al.
5,293,655 A 3/1994 VanWinkle et al.
5,819,340 A * 10/1998 Kelly ..... 5/95
6,202,228 B1 3/2001 Cox
6,862,757 B2 * 3/2005 Andriunas et al. ..... 5/95
2003/0037372 A1 2/2003 Andriunas et al.
2004/0078895 A1 4/2004 Elling
2006/0000019 A1 1/2006 Martin

* cited by examiner

*Primary Examiner*—Michael Trettel

(57) ABSTRACT

An infant sleeping apparatus for providing an infant sleeping enclosure that can rest on top of a mattress comprising an enclosure component having an open top, a base, a front rail, a back rail, and a first and second side rail; and a mattress securing mechanism comprising one or more U-shaped support bars attached to the base of the enclosure for allowing the apparatus to be attached to the mattress.

4 Claims, 3 Drawing Sheets

FOLDABLE INFANT SLEEPING APPARATUS

FIELD OF THE INVENTION

The present invention is directed to an infant sleeping enclosure that can attach securely to an adult bed.

BACKGROUND OF THE INVENTION

The present invention features an infant sleeping apparatus for providing an infant sleeping enclosure that can rest on top of a mattress. The infant sleeping apparatus comprises an enclosure component having an open top, a base, a front rail, a back rail, a first side rail and a second side rail. The infant sleeping apparatus further comprises a mattress securing mechanism comprising one or more U-shaped support bars attached to the base of the enclosure for sliding the enclosure onto a mattress.

The infant sleeping apparatus of the present invention provides an enclosed sleeping area for attaching to a bed so that an infant can rest next to his/her mother and/or father and/or caretaker. The infant sleeping apparatus of the present invention also prevents an adult from rolling on to the infant while he/she is sleeping and prevents the infant from rolling off of the bed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
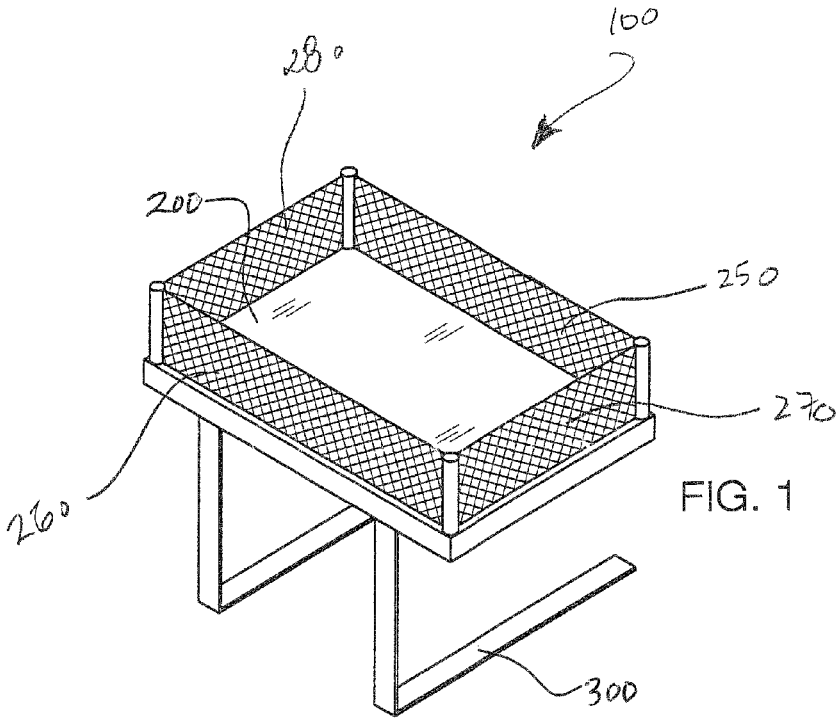
FIG. 1 is a perspective view of the infant sleeping apparatus of the present invention.
Figure 2:
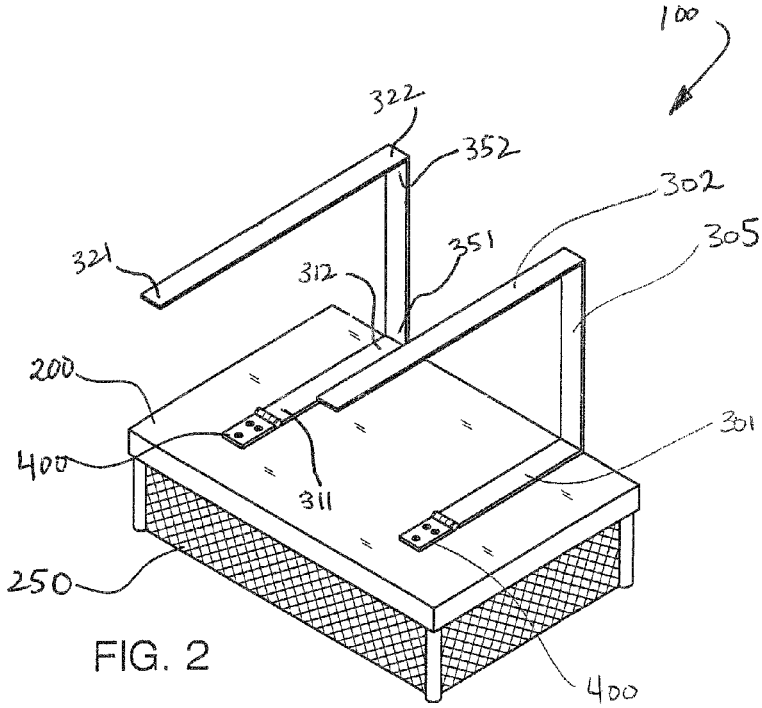
FIG. 2 is a perspective view of the infant sleeping apparatus of the present invention.

Referring now to FIGS. 1-6, the present invention features an infant sleeping apparatus 100 for providing a sleeping enclosure that can rest on a top 501 of a mattress 500. The infant sleeping apparatus 100 comprises an enclosure component having an open top, a base 200, a front rail 250, a back rail 260, a first side rail 270, and a second side rail 280. The infant sleeping apparatus 100 further comprises a mattress securing mechanism comprising one or more generally U-shaped support bars 300. Each support bar 300 has a first leg 301, a second leg 302, and a connecting bar 305, wherein the first leg 301 has a first end 311 and a second end 312, wherein the second leg 302 has a first end 321 and a second end 322, and the connecting bar 305 has a first end 351 and a second end 352. The second end 312 of the first leg 301 is attached to the first end 351 of the connecting bar 350 and the second end 322 of the second leg 302 is attached to the second end 352 of the connecting bar 305 (see FIG. 1, FIG. 2).

The first end 311 of the first leg 301 is pivotally attached to the base 300 of the enclosure component via a hinge mechanism 400. This allows the infant sleeping apparatus 100 to move between a folded storage position and an unfolded position. In the folded storage position, the second leg 302 can be pivoted over the enclosure component via the hinge mechanism 400 such that it rests atop the front rail 250. In the unfolded position, the support bars 300 can be attached to a side 505 of the mattress 500 such that the enclosure component rests on the top 501 of the mattress 500 (see FIG. 4, FIG. 5).

Figure 3:
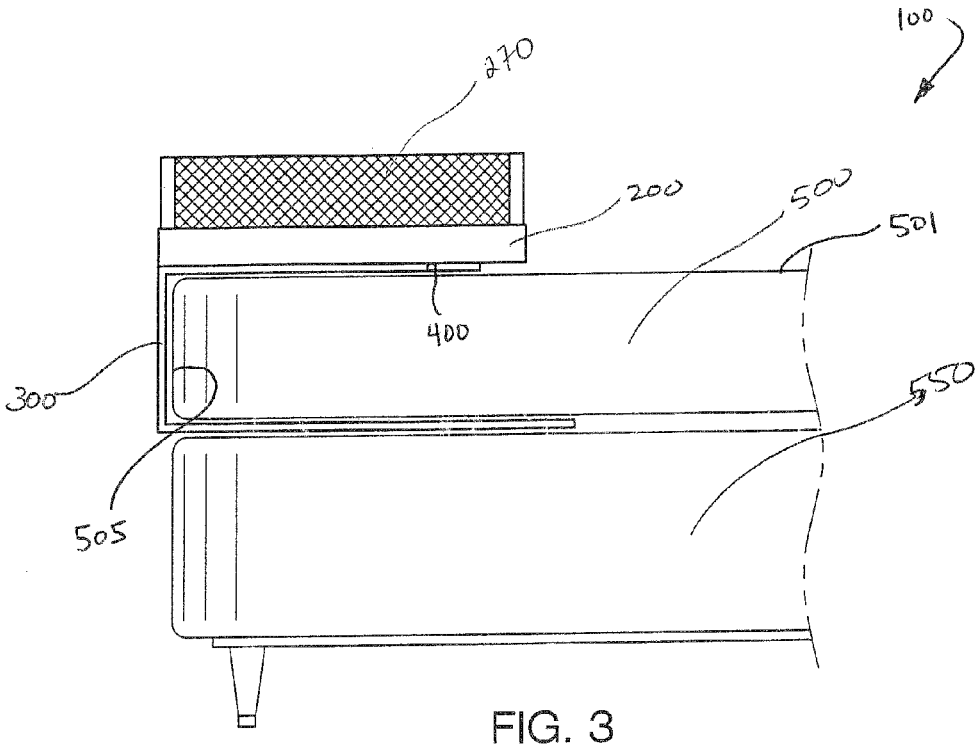
FIG. 3 is a side view of the infant sleeping apparatus of the present invention, wherein the infant sleeping apparatus is attached to a mattress.
Figure 4:
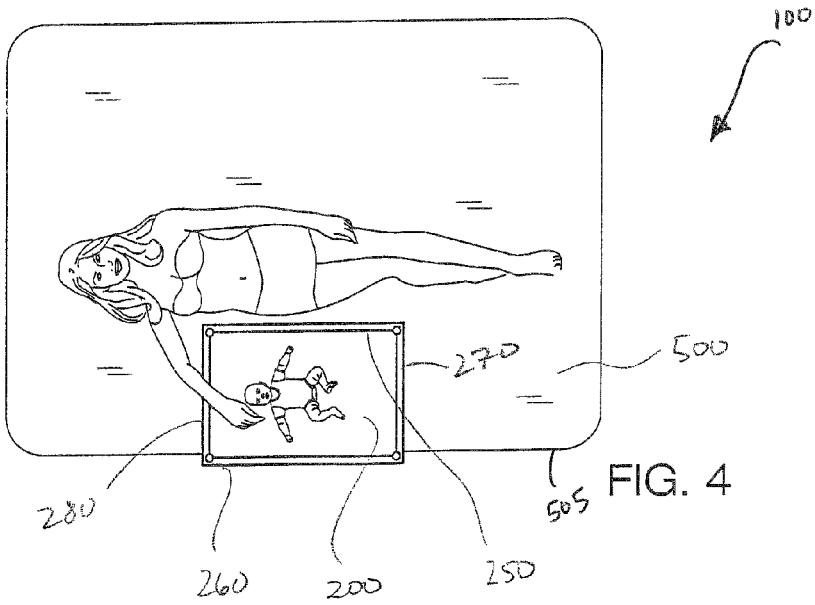
FIG. 4 is a top view of the infant sleeping apparatus of the present invention, wherein the infant sleeping apparatus is attached to a mattress.
Figure 5:
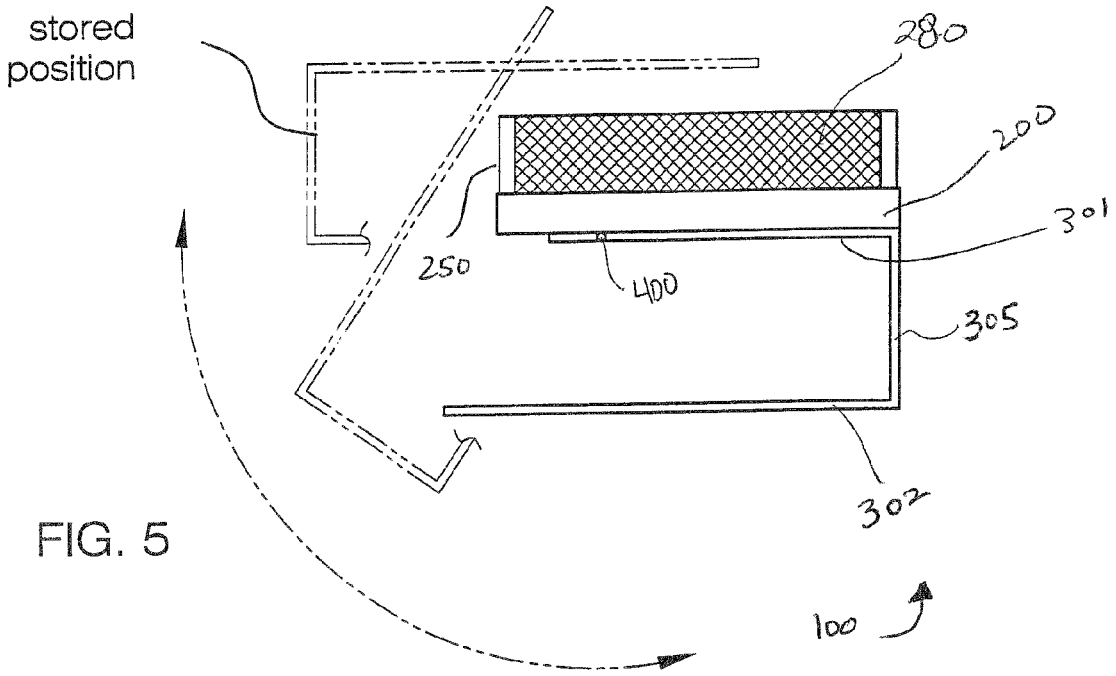
FIG. 5 is a side view of the infant sleeping apparatus of the present invention, wherein the infant sleeping apparatus is moved from a folded storage position and an unfolded position.

In some embodiments, the support bar 300 (e.g., second leg 302) is inserted between the mattress 500 and the box spring 550 of the bed (see FIG. 3).

In some embodiments, an infant mattress, a blanket, the like, or a combination thereof is placed on top of the base 200 of the enclosure component for providing the infant a comfortable sleeping environment.

The infant sleeping apparatus 100 of the present invention may be constructed from a variety of materials. In some embodiments, the infant sleeping apparatus 100 is constructed from material comprising a plastic, a rubber, a metal, the like, or a combination thereof.

Figure 6:
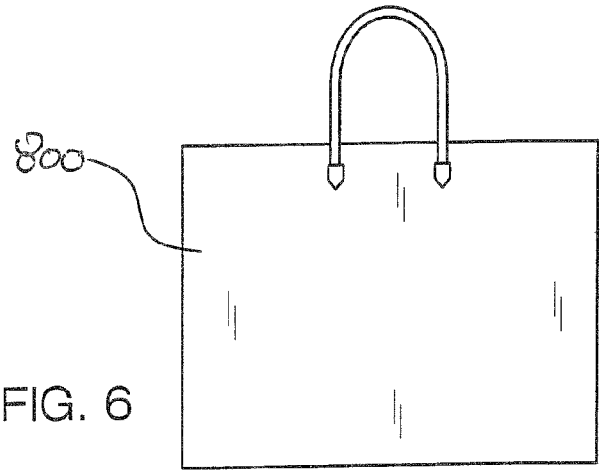
FIG. 6 is a front view of a carrying case for the infant sleeping apparatus of the present invention.

In some embodiments, the infant sleeping device further comprises a carrying case 800 for storing the infant sleeping device 100 when not in use (see FIG. 6).

The infant sleeping apparatus 100 of the present invention may be constructed in a variety of shapes and/or sizes. In some embodiments, the enclosure component is rectangular, square, circular, oval, the like, or a combination thereof.

As used herein, the term "about" refers to plus or minus 10% of the referenced number. For example, an embodiment wherein the enclosure component is about 15 inches wide includes an enclosure component that is between 13.5 and 16.5 inches wide.

In some embodiments, the enclosure component is between about 8 to 12 inches long as measured from the front rail to the back rail. In some embodiments, the enclosure component is between about 12 to 15 inches long as measured from the front rail to the back rail. In some embodiments, the enclosure component is between about 15 to 20 inches long as measured from the front rail to the back rail. In some embodiments, the enclosure i component s between about 20 to 30 inches long as measured from the front rail to the back rail.

In some embodiments, the enclosure component is between about 8 to 12 inches wide as measured from the first side rail to the second side rail. In some embodiments, the enclosure component is between about 12 to 15 inches wide as measured from the first side rail to the second side rail. In some embodiments, the enclosure component is between about 15 to 20 inches wide as measured from the first side rail to the second side rail. In some embodiments, the enclosure component is between about 20 to 30 inches wide as measured from the first side rail to the second side rail.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An infant sleeping apparatus for providing a sleeping enclosure that can rest on a top of a mattress, said infant sleeping apparatus comprising:

(a) an enclosure component having an open top, a base, a front rail, a back rail, a first side rail, and a second side rail; and (b) a mattress securing mechanism comprising a generally U-shaped support bar having a first leg, a second leg, and a connecting bar; wherein the first leg has a first end and a second end, wherein the second leg has a first end and a second end, and the connecting bar has a first end and a second end; wherein the second end of the first leg is attached to the first end of the connecting bar; wherein the second end of the second leg is attached to the second end of the connecting bar;

wherein the first end of the first leg is pivotally attached to the base of the enclosure component via a hinge mechanism allowing the infant sleeping apparatus to move between a folded storage position and an unfolded position; wherein when the infant sleeping apparatus is in the folded storage position, the second leg can be pivoted over the enclosure component via the hinge mechanism such that it rests atop the front rail; wherein when the infant sleeping apparatus is in the unfolded position, the support bar can be attached to a side of the mattress such that the enclosure component rests on the top of the mattress.

2. The infant sleeping apparatus of claim 1, wherein the mattress securing mechanism comprises more than one U-shaped support bar.

3. The infant sleeping apparatus of claim 1, wherein the enclosure component is square, rectangular, circular, oval, the like, or a combination thereof.

4. The infant sleeping apparatus of claim 1, wherein the infant sleeping apparatus further comprises a carrying case for storing the infant sleeping device.

* * * * *